US006051353A

United States Patent [19]

Hoffend et al.

[11] Patent Number: 6,051,353

[45] Date of Patent: Apr. 18, 2000

[54] COATED CARRIERS

[75] Inventors: Thomas R. Hoffend, Webster; Robert D. Bayley, Fairport; Carol A. Fox, Canandaigua; John G. VanDusen, Walworth; Scott M. Silence, Fairport; K. Derek Henderson, Rochester, all of N.Y.; Charles H. Honeyman, Allston, Mass.; Paula J. MacLeod, Etobicoke, Canada; Paul F. Smith, Toronto, Canada; Thomas E. Enright, Bradford, Canada

[73] Assignee: Xerox Corporation, Stamford, Conn.

[21] Appl. No.: 09/391,873

[22] Filed: Sep. 7, 1999

[51] Int. Cl.[7] ..... G03G 9/107; G03G 9/113

[52] U.S. Cl. ..... 430/106.6; 430/108

[58] Field of Search ..... 430/106.6, 108

[56] References Cited

U.S. PATENT DOCUMENTS

| | | | |
|---|---|---|---|
| 3,533,835 | 10/1970 | Hagenbach et al. | 430/108 |
| 3,590,000 | 6/1971 | Palermiti et al. | 430/110 |
| 3,658,500 | 4/1972 | Hagenbach | 430/108 |
| 3,798,167 | 3/1974 | Kukla et al. | 430/108 |
| 3,916,065 | 10/1975 | Moriconi et al. | 430/108 |
| 3,918,968 | 11/1975 | Kukla et al. | 430/108 |
| 3,922,382 | 11/1975 | Kukla et al. | 430/108 |
| 3,939,086 | 2/1976 | Hagenbach | 430/108 |
| 4,233,387 | 11/1980 | Mammino et al. | 430/137 |
| 4,238,558 | 12/1980 | Ziolo | 430/108 |
| 4,264,697 | 4/1981 | Perez et al. | 430/107 |
| 4,310,611 | 1/1982 | Miskinis | 430/107 |
| 4,397,935 | 8/1983 | Ciccarelli et al. | 430/110 |
| 4,434,220 | 2/1984 | Abbott et al. | 430/108 |
| 4,810,611 | 3/1989 | Ziolo et al. | 430/106.6 |
| 4,935,326 | 6/1990 | Creatura et al. | 430/108 |
| 4,937,166 | 6/1990 | Creatura et al. | 430/108 |

FOREIGN PATENT DOCUMENTS

| | | | |
|---|---|---|---|
| 53-129041 | 11/1978 | Japan | 430/108 |
| 58-117555 | 7/1983 | Japan | 430/108 |

*Primary Examiner*—Roland Martin
*Attorney, Agent, or Firm*—E. O. Palazzo

[57] ABSTRACT

A carrier comprised of a core and thereover a polymer generated from the reaction of a component containing amine groups and a component containing epoxy groups.

37 Claims, No Drawings

COATED CARRIERS

PENDING APPLICATIONS AND PATENTS

Illustrated in copending applications and patents U.S. Pat. No. 5,945,244 U.S. Ser. No. 140,524; U.S. Ser. No. 140,439; and U.S. Pat. No. 5,935,750; U.S. Pat. No. 6,004,712, the disclosures of each of which are totally incorporated herein by reference, are carrier particles comprised, for example, of a core with coating thereover of polystyrene/olefin/ dialkylaminoalkyl methacrylate, polystyrene/methacrylate/ dialkylaminoalkyl methacrylate, and polystyrene/ dialkylaminoalkyl methacrylate. More specifically, there is illustrated in U.S. Pat. No. 5,945,244 a carrier comprised of a core, and thereover a polymer of styrene, an olefin and a dialkylaminoalkyl methacrylate; in copending application U.S. Ser. No. 140,524 a carrier composition comprised of a core and thereover a polymer of (1) polystyrene/alkyl methacrylate/dialkylaminoethyl methacrylate, (2) polystyrene/alkyl methacrylate/alkyl hydrogen aminoethyl methacrylate, (3) polystyrene/alkyl acrylate/ dialkylaminoethyl methacrylate, or (4) polystyrene/alkyl acrylate/alkyl hydrogen aminoethyl methacrylate; in copending application U.S. Ser. No. 140,439 a carrier comprised of a core and a polymer coating of (1) styrene/ monoalkylaminoalkyl methacrylate or (2) styrene/ dialkylaminoalkyl methacrylate; in U.S. Pat. No. 5,935,750 a carrier comprised of a core and a polymer coating containing a quaternary ammonium salt functionality; and in U.S. Pat. No. 6,004,712 a carrier comprised of a core and thereover a polymer of (1) methylmethacrylate and a monoalkyl aminoalkyl methacrylate, or (2) a polymer of methylmethacrylate and dialkylaminoalkyl methacrylate.

Illustrated in U.S. Ser. No. 09/385,506, the disclosure of which is totally incorporated herein by reference, is a carrier comprised of a core and thereover a ferrocene containing polymer.

The appropriate components and processes of the above recited copending applications may be selected for the present invention in embodiments thereof.

BACKGROUND OF THE INVENTION

This invention is generally directed to developer compositions, and more specifically, the present invention relates to developer compositions with coated carrier components, or coated carrier particles that can be prepared by, for example, solution and preferably by dry powder processes. More specifically, the present invention relates to compositions, especially carrier compositions comprised of a core, and thereover a polymer, or polymers with amine, such as a number of the amines of the above copending applications including copolymers of methylmethacrylate and an amino or a monoalkylamino methacrylate and oxirane, or epoxy functionality, such as polymers containing glycidyl methacrylate including poly(methyl methacrylate-co-glycidylmethacrylate).

In embodiments of the present invention, the carrier particles are comprised of a core with a coating thereover comprised of mixtures of copolymers of an alkyl methacrylate, an alkyl acrylate or styrene and an amine, such as 2-amino-2-methylpropyl methacrylate, substituted alkyl aminoethyl methacrylate, t-butylaminoethyl methacrylate, and the like, and copolymers of an alkyl methacrylate, an alkyl acrylate or styrene and an epode, such as glycidyl-methacrylate. Also included in embodiments of the present invention are carrier particles comprised of a core with a coating thereover of a terpolymer comprised of an alkyl methacrylate, an alkyl acrylate or styrene, and an amine, such as 2-amino-2-methylpropyl methacrylate, substituted mono alkyl aminoethyl methacrylate, t-butylaminoethyl methacrylate, and the like, and an epoxide, such as glycidyl-methacrylate. The carrier may include the polymer coating thereover in admixture with other suitable polymers, and more specifically, with a third polymer, such as a fluoropolymer, polymethylmethacrylate, poly(urethane), especially a crosslinked polyurethane, such as a poly (urethane)polyester and the like, and moreover, the copolymer coating may contain a conductive component, such as carbon black, and which conductive component is preferably dispersed in the polymer coating. Preferably, with the presence of a conductive component, there can be enabled carriers with increased developer triboelectric response at relative humidities of from about 20 to about 90 percent, improved image quality performance, excellent high conductivity ranges of from about $10^{-10}$ to about $10^{-7}$ (ohm-cm)$^{-1}$, and the like. An important advantage associated with the carriers of the present invention with the epoxy/amine polymer coatings thereover include the enablement of a crosslinked polymer through the reaction of the epoxy and amine groups, which permits for example, robust, extended life carriers, with lifetimes for example, of about 1,000,000 imaging cycles, a high triboelectrical charge, for example a carrier tribo range of from about a plus (positive charge) 50 to about 150, or to about 95 microcoulombs per gram, and preferably from about a positive 55 to about a positive 90 microcoulombs per gram, and most preferably from about a positive 60 to about a positive 70 microcoulombs per gram.

The carrier particles of the present invention can be selected for a number of different imaging systems and devices, such as xerographic copiers and printers, inclusive of high speed color xerographic systems, printers, digital systems, such as the Xerox Corporation 1090 Marathon, Document Centre 265, the DocuTech series, DocuColor 40, and the like, and wherein monochrome or colored images with excellent and substantially no background deposits are achievable. Developer compositions comprised of the carrier particles illustrated herein and prepared, for example, by a solution or dry coating process are generally useful in electrostatographic or electrophotographic imaging systems, especially xerographic imaging and printing processes, and digital processes. Additionally, the invention developer compositions comprised of substantially conductive carrier particles can be selected for imaging methods wherein relatively constant conductivity parameters are desired. Furthermore, in the aforementioned imaging processes the triboelectric charge on the carrier particles can be preselected, which charge is dependent, for example, on the polymer composition and dispersant component applied to the carrier core, and optionally the type and amount of the conductive component selected.

PRIOR ART

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Moreover, of importance with respect to the aforementioned developer compositions is the appropriate triboelectric charging values associated therewith, especially at a variety of relative humidities.

Carrier particles for use in the development of electrostatic latent images are described in many patents including, for example, U.S. Pat. No. 3,590,000, the disclosure of which is totally incorporated herein by reference. These carrier particles can contain various cores, including steel, with a coating thereover of fluoropolymers, and terpolymers of styrene, methacrylate, and silane compounds. A number of these coatings can deteriorate rapidly, especially when selected for a continuous xerographic process where a portion of, or the entire coating may separate from the carrier core in the form of, for example, chips or flakes, and which resulting carrier can fail upon impact, or abrasive contact with machine parts and other carrier particles. These flakes or chips, which cannot generally be reclaimed from the developer mixture, usually adversely effect the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity, and relatively low triboelectrical values.

There is illustrated in U.S. Pat. No. 4,233,387, the disclosure of which is totally incorporated herein by reference, coated carrier components comprised of finely divided toner particles clinging to the surface of the carrier particles. Specifically, there is disclosed in this patent coated carrier particles obtained by mixing carrier core particles of an average diameter of from between about 30 microns to about 1,000 microns with from about 0.05 percent to about 3.0 percent by weight, based on the weight of the coated carrier particles, of thermoplastic or thermosetting resin particles. The resulting mixture is then dry blended until the resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the resin particles to melt and fuse on the carrier core.

There is illustrated in U.S. Pat. Nos. 4,937,166 and 4,935,326, the disclosures of which are totally incorporated herein by reference, carrier containing a mixture of polymers, such as two polymers, not in close proximity in the triboelectric series. Moreover, in U.S. Pat. No. 4,810,611, the disclosure of which is totally incorporated herein by reference, there is disclosed the addition to carrier coatings of colorless conductive metal halides in an amount of from about 25 to about 75 weight percent, such halides including copper iodide, copper fluoride, and mixtures thereof. The appropriate components and processes of the '166 and '326 patents may be selected for the present invention in embodiments thereof. The present invention are advantageous compared to this prior art in achieving high stable positive triboelectric charge on the carrier particles, that is high, up to about 150 negative triboelectric charge is imparted to the toner particles developed onto a photoreceptor in, for example, a xerographic development environment. Further, the full range of electrical properties of the carrier particles can be achieved at high triboelectric charging values, from carrier conductivities of about $10^{-17}$ mho/cm to about $16^{-6}$ mho/cm, that is, from the insulative to the conductive regime, and the carrier triboelectric charge and carrier conductivity can be varied and preselected.

With further reference to the prior art, carriers obtained by applying insulating resinous coatings to porous metallic carrier cores using solution coating techniques can be undesirable from many viewpoints. For example, the coating can reside primarily in some of the pores of the carrier cores, rather than at the surfaces thereof; and therefore, is not available for triboelectric charging when the coated carrier particles are mixed with finely divided toner particles. Attempts to resolve this problem by increasing the carrier coating weights, for example to as much as 3 percent or greater, to provide an effective triboelectric coating to the carrier particles necessarily involves processing excessive quantities of solvents, and further, usually these processes result in low product yields. Also, solution coated carrier particles, when combined and mixed with finely divided toner particles, provide in some instances triboelectric charging values which are too low for many uses. The powder coating processes of the present invention overcome or minimize these disadvantages, and further enable developers that are capable of generating high triboelectric charging values with finely divided toner particles; and also wherein the carrier particles in embodiments are of substantially constant conductivity. However, solution coating processes may selected to prepare the carrier coatings of the present invention in embodiments thereof.

When resin coated carrier particles are prepared by powder coating process the majority of the coating materials are fused to the carrier surface thereby reducing the number of toner impaction sites on the carrier. Additionally, there can be achieved with the process of the present invention and the carriers thereof, independent of one another, desirable triboelectric charging characteristics and conductivity values; that is, for example, the triboelectric charging parameter is not dependent on the carrier coating weight as is believed to be the situation with the process of U.S. Pat. No. 4,233,387 wherein an increase in coating weight on the carrier particles may function to also permit an increase in the triboelectric charging characteristics. Specifically, therefore, with the carrier compositions and process of the present invention there can be formulated developers with selected high triboelectric charging characteristics and/or conductivity values in a number of different combinations. Thus, for example, there can be formulated in accordance with the invention of the present application developers with conductivities as determined in a magnetic brush conducting cell of from about $10^{-6}$ (ohm-cm)$^{-1}$ to about $10^{-17}$ (ohm-cm)$^{-1}$, preferably from about $10^{-10}$ (ohm-cm)$^{-1}$ to about $10^{-6}$ (ohm-cm)$^{31\ 1}$, and most preferably from about $10^{-8}$ (ohm-cm)$^{-1}$ to about $10^{-6}$ (ohm-cm)$^{-1}$, and high carrier triboelectric charging values of from about 20 to about 150, and, for example, from a positive about 45 to a positive about 90, microcoulombs per gram on the carrier particles as determined by the known Faraday Cage technique. Therefore, the developers of the present invention can be formulated with conductivity values in a certain range with different triboelectric charging characteristics by, for example, maintaining the same total coating weight on the carrier particles.

Other U.S. Patents that may be of interest include U.S. Pat. No. 3,939,086, which illustrates steel carrier beads with polyethylene coatings, see-column 6; U.S. Pat. Nos. 4,264,697; 3,533,835; 3,658,500; 3,798,167; 3,918,968; 3,922,382; 4,238,558; 4,310,611; 4,397,935; and 4,434,220, the disclosures of each of these patents being totally incorporated herein by reference.

SUMMARY OF THE INVENTION

It is a feature of the present invention to provide toner and developer compositions with carrier particles containing polymer coatings.

In another feature of the present invention there are provided dry coating processes for generating carrier particles of substantially constant conductivity parameters.

In yet another feature of the present invention there are provided dry coating processes for generating carrier particles of substantially constant conductivity parameters, and high triboelectric charging values.

In yet a further feature of the present invention there are provided carrier particles with high tribo values of at least about 50 microcoulombs per gram, and wherein the carrier includes thereover a crosslinked epoxy/amine polymer or a coating of two polymers wherein the second polymer is a copolymer of polymethylmethacrylate, and poly(urethane), and wherein the coating may contain therein a conductive component of, for example, carbon black.

Aspects of the present invention relate to a carrier comprised of a core and thereover a polymer generated from the reaction of a component containing amine groups and a component containing epoxy groups; a carrier wherein the amine groups are generated from an aminoalkyl methacrylate, or monoalkyl aminoalkyl methacrylate, and the epoxy groups are generated from glycidyl methacrylate; a carrier wherein each of the alkyl independently contains from 1 to about 25 carbon atoms; a carrier wherein each of the alkyl independently contains from 1 to about 6 carbon atoms; a carrier wherein the polymer is a copolymer of an aminoalkyl methacrylate, or monoalkyl aminoalkyl methacrylate and glycidyl methacrylate; a carrier wherein the epoxy groups are generated from glycidyl methacrylate, diglycidyl 1,2,3,6-tetrahydrophthalate, 1,2-epoxy-9-decene, 1,2-epoxy-5-hexene, 1,2-epoxy-7-octene, 3,4-epoxy-1-butene, poly(phenyl glycidyl ether), bisphenol A glycerolate (1 glycerol/phenol) diacrylate, or glycidyl vinylbenzyl ether; a carrier wherein the copolymer contains from about 5 to about 20 mole percent of amine groups and from about 5 to about 20 mole percent of epoxy groups with the remainder of the polymer optionally being comprised of non-amino and non-epoxy monomers of styrene, vinyl toluene, methyl methacrylate, butyl styrene, neopentyl methacrylate, isobutyl methacrylate or isobutyl acrylate; a carrier wherein the polymer possesses an Mw of from about 20,000 to about 2,000,000, and an Mn of from about 12,000 to about 2,000,000; a carrier wherein the polymer is a copolymer and the coating weight thereof is from about 0.1 to about 20 weight percent; a carrier wherein the polymer coating weight is from about 1 to about 3 weight percent; a carrier wherein the polymer contains a conductive component; a carrier wherein the conductive component is a metal oxide, or is carbon black; a carrier wherein the conductive component is carbon black selected in an amount of from about 10 to about 60 weight percent; a carrier wherein the core is a metal, a metal oxide, or a ferrite; a carrier with a triboelectric charge of from about a positive 50 to about a positive 150 microcoulombs per gram; a carrier with a triboelectric charge of from about a positive 50 to about a positive 70 microcoulombs per gram; a developer wherein the toner is comprised of resin and colorant; a developer wherein the colorant is a pigment and the resin is a styrene copolymer, or a polyester; a developer comprised of a (1) carrier core and coating layer of a polymer, or polymers generated from a component containing at least one epoxy group and amine group, and (2) a toner; a developer wherein the carrier core is selected from the group consisting of iron, ferrites, steel and nickel; a developer with a carrier triboelectric charge of from about a positive 50 to about a positive 150 microcoulombs per gram, and a toner triboelectric charge of from about a negative 50 to about a negative 150 microcoulombs per gram; a developer with a carrier triboelectric charge of from about a positive 60 to about a positive 70 microcoulombs per gram, and a toner triboelectric charge of from about a negative 60 to about a negative 70 microcoulombs per gram; a carrier wherein the amine component is a copolymer of poly methyl methacrylate-co-2-amino-2-methylpropyl methacrylate, poly methyl methacrylate-co-3-amino-3-methyl-1-butyl methacrylate, poly methyl methacrylate-co-2-amino-2-methylhexyl methacrylate, poly methyl methacrylate-co-t-butylaminoethyl methacrylate, poly styrene-co-2-amino-2-methylpropyl methacrylate; poly styrene-co-t-butylaminoethyl methacrylate, poly styrene-co-3-amino-3-methyl-1-butyl methacrylate, and poly styrene-co-2-amino-2-methylhexyl methacrylate; and the epoxy component is poly methyl methacrylate-co-glycidyl methacrylate and poly styrene-co-glycidyl methacrylate; a carrier wherein the coating contains a further polymer coating; a carrier wherein the further coating is comprised of a styrene acrylate, a styrene methacrylate, or a fluoropolymer; a carrier wherein the further coating is comprised of a polyurethane, and which polyurethane optionally contains dispersed therein conductive components; a carrier wherein the further coating is comprised of a polyurethane/polyester with carbon black optionally dispersed therein; a carrier wherein the alkyl aminoethyl methacrylate is a tertiarybutylaminoethyl methacrylate; an imaging process which comprises developing an image with the developer illustrated herein; a process for the preparation of the carrier by the dry mixing and heating of the core and the coating; a carrier wherein the polymer resulting possesses weight average molecular weights of from about 15,000 to about 500,000 and number average molecular weight values $M_n$ of from about 7,000 to about 220,000; a carrier wherein the amine containing component is a monomer and the epoxy containing component is a monomer; a carrier comprised of a core and a component thereover comprised of an epoxy/amine polymer; a carrier wherein the polymer is crosslinked; a carrier wherein the polymer is generated from monomers; a carrier wherein the polymer is generated from polymers; a carrier wherein the amine containing component is a polymer; a carrier wherein the component containing epoxy groups is a polymer; a carrier wherein a reaction is accomplished between an epoxy polymer and an amine polymer; a carrier comprised of a core and thereover a polymer generated from the reaction of a polymer component containing amine groups and a polymer component containing epoxy groups; a carrier wherein there is selected for the polymer components a terpolymer; a carrier comprised of a core and thereover a polymer inclusive of crosslinked polymers generated from (1) an amine and an epoxy, and which amines can be an aminoalkyl methacrylate such as 2-amino-2-methylpropyl methacrylate, a monoalkyl aminoalkyl methacrylate such as t-butylaminoethyl methacrylate, and the like, and wherein the epoxy may be derived from a glycidyl methacrylate, a carrier wherein each of the polymer alkyls independently contains from 1 to about 25 carbon atoms, and wherein the polymer is comprised of polymers; a carrier wherein each alkyl independently contains from 1 to about 6 carbon atoms; a carrier wherein the polymer coating is a crosslinked, with a crosslink density of between about 0.0001 and about 0.1, preferably between about 0.001 and about 0.01 and where the crosslink density refers to the number of polymer to polymer chemical bonds (crosslinks) divided by the total number of monomeric units in the polymer; that is, 0.01 crosslink density represents one crosslink per 100 monomer units; copolymers of t-butylaminoethyl methacrylate, and an oxirane, or epoxy, such as glycidyl methacrylate, or a copolymer of an amine and haloalkylmethylstyrenes; a carrier wherein the crosslinked copolymer coating contains from about 5 to 20 mole percent of an aminoalkyl methacrylate and from about 5 to 20 mole percent of an epoxy component, with the balance of the polymer being composed of non-amino and non-epoxy monomers such as an acrylate like methylmethacrylate; a carrier wherein the copolymer coating possesses an $M_w$ of from about 20,000 to about 900,000, or greater than about 1,000,000, for example about 1,000,000 to about 3,000,000 and of an $M_n$ of from about 12,000 to about 350,000, or greater than about 1,000,000, for example about 1,000,000 to about 3,000,00; a carrier wherein the polymer coating is a crosslinked copolymer generated from an amino compound, such as vinyl polymers with primary or secondary amine groups, and epoxide groups on the same polymer, and the coating weight thereof is from about 0.1 to about 20 weight percent; a carrier wherein the polymer coating weight is from about 1 to about 3 weight percent; a carrier wherein the polymer coating contains a conductive component; a carrier wherein the conductive component is a metal oxide, or is carbon black; a carrier wherein the conductive component is carbon black selected in an amount of from about 10 to about 60 weight percent; a carrier wherein the core is a metal, a metal oxide, or a ferrite including strontium ferrites; a carrier with a triboelectric charge of from about a positive 50 to about a positive 150 microcoulombs per gram; a carrier with a triboelectric charge of from about a positive 50 to about a positive 70 microcoulombs per gram; a developer wherein the toner is comprised of thermoplastic resin and colorant; a developer wherein the colorant is a pigment and the toner resin is a styrene copolymer, or a polyester; a developer comprised of a (1) carrier core and coating layer of a copolymer containing amine and epoxy groups or moieties, and (2) a toner; a developer wherein the carrier core is selected from the group consisting of iron, ferrites, steel and nickel powdered cores; a developer with a carrier triboelectric charge of from about a positive 50 to about a positive 150 microcoulombs per gram, and a toner triboelectric charge of from about a negative 50 to about a negative 150 microcoulombs per gram; a developer with a carrier triboelectric charge of from about a positive 60 to about a positive 70 microcoulombs per gram, and a toner triboelectric charge of from about a negative 60 to about a negative 70 microcoulombs per gram; a carrier wherein the polymer coating is generated from polymers that contain at least one amine and at least one epoxy group, and wherein the amines are for example, tertiary-butylaminoethyl methacrylate, aminoethyl methacrylate, and a monoalkylaminoethyl methacrylate; a carrier wherein the carrier contains a second polymer coating; a carrier wherein the second coating is comprised of a styrene acrylate, a styrene methacrylate, or a fluoropolymer; a carrier wherein the second coating is comprised of a polyurethane and which polyurethane optionally contains dispersed therein conductive components; and a carrier wherein the second coating is comprised of a polyurethane/polyester with carbon black optionally dispersed therein; developer compositions comprised of toner particles, and carrier particles prepared, for example, by a powder coating process, and wherein the carrier particles are comprised of a core with certain coatings thereover; carrier particles prepared by mixing low density porous magnetic, or magnetically attractable metal core carrier particles with from, for example, between about 0.05 percent and about 3 percent by weight, based on the weight of the coated carrier particles, of epoxy/amine polymers, and which polymer may optionally contain dispersed therein carbon black or a similar conductive component, until adherence thereof to the carrier core by mechanical impaction or electrostatic attraction; heating the resulting mixture of carrier core particles and polymer to a temperature, for example, of between from about 200° F. to about 625° F., preferably about 400° F. for an effective period of, for example, from about 10 minutes to about 60 minutes enabling the polymer to melt and fuse to the carrier core particles; cooling the coated carrier particles; and thereafter, classifying the obtained carrier particles to a desired particle size of, for example, from about 50 to about 200 microns in diameter.

Specifically, the present invention relates to a composition comprised of a core, and thereover a crosslinked epoxy and nitrogen-containing copolymer present in an amount of from about 0.05 to about 3 weight percent of the total carrier composition, and which copolymer may optionally contain a conductive component, such as a metal oxide, or a pigment like preferably carbon black, wherein the conductive component is selected, for example, in an amount of from about 10 to about 75 weight percent, and preferably from about 15 to 50 weight percent, based on the sum of the epoxy/nitrogen-containing polymer and conductive component; a carrier with two polymers thereover, wherein the first polymer is an epoxide nitrogen-containing copolymer and wherein the conductive component for either the first or second polymer is a metal oxide, or a pigment selected in an amount of from about 10 to about 50 weight percent; and wherein the second polymer is as illustrated herein, that is for example, a fluorocarbon, polymethylmethacrylate (PMMA), a thermosetting polymer, such as a thermosetting polyurethane, a polyester, a styrene based polymer, or a second a nitrogen-containing copolymer, and wherein the first polymer is selected in an amount of from about 1 to about 100, or from about 10 to about 75 weight percent, based on the total weights of all polymers and conductive components present in the carrier and the second polymer is selected in an amount of from about 99 to about 0, or from about 90 to about 25 weight percent, based on the total weights of all polymers and conductive components present in the carrier; and wherein the carrier core is a metal, a ferrite, a metal oxide, and the like, inclusive of known carrier cores. Also, in embodiments there are provided carriers with coatings of crosslinked copolymers containing amine and epoxy groups, and mixtures of these crosslinked copolymers and a second polymer, such as PMMA, a thermosetting polyurethane, and the like inclusive of suitable known polymers.

Various suitable solid core carrier materials can be selected for the carriers and developers of the present invention. Characteristic core properties of importance include those that will enable the toner particles to acquire a positive charge or a negative charge, and carrier cores that will permit desirable flow properties in the developer reservoir present in the xerographic imaging apparatus. Also of importance with regard to the carrier core properties are, for example, suitable magnetic characteristics that will permit magnetic brush formation in magnetic brush development processes; and also wherein the carrier cores possess desirable mechanical aging characteristics; and further, for example, a suitable core surface morphology to permit high electrical conductivity of the developer comprising the carrier and a suitable toner. Examples of carrier cores that can be selected include iron or steel, such as atomized iron or steel powders available from Hoeganaes Corporation or Pomaton S.p.A (Italy), ferrites such as Cu/Zn-ferrite containing, for example, about 11 percent copper oxide, 19 percent zinc oxide, and 70 percent iron oxide and available from D. M. Steward Corporation or Powdertech Corporation, Ni/Zn-ferrite available from Powdertech Corporation, Sr (strontium)-ferrite, containing, for example, about 14 percent strontium oxide and 86 percent iron oxide and available from Powdertech Corporation Ba-ferrite, magnetites, available, for example, from Hoeganaes Corporation (Sweden), nickel, mixtures thereof, and the like. Preferred carrier cores include ferrites, and sponge iron, or steel grit with an average particle size diameter of, for example, from between about 30 microns to about 400 microns, and preferably from about 50 to about 50 microns.

Examples of polymers selected are primarily generated from components containing both amines and epoxide groups, such as a aminoalkyl, or monoalkyl amine, such as 2-amino-2-methylpropyl methacrylate, 3-amino-3-methyl-1-butyl methacrylate, 2-amino-2-methyl-1-pentyl methacrylate, 2-amino-2-methylhexyl methacrylate, or t-butylaminoethyl methacrylate; and the like, with examples of epoxy generating components being glycidyl methacrylate, diglycidyl 1,2,3,6-tetrahydrophthalate, 1,2-epoxy-9-decene, 1,2-epoxy-5-hexene, 1,2-epoxy-7-octene, 3,4-epoxy-1-butene, poly(phenyl glycidyl ether), bisphenol A glycerolate (1 glycerol/phenol) diacrylate, glycidyl vinylbenzyl ether. Specific examples of amine polymers used in the copolymer coatings are poly methyl methacrylate-co-2-amino-2-methylpropyl methacrylate, poly methyl methacrylate-co-3-amino-3-methyl-1-butyl methacrylate, poly methyl methacrylate-co-2-amino-2-methylhexyl methacrylate, poly methyl methacrylate-co-t-butylaminoethyl methacrylate, poly styrene-co-t-butylaminoethyl methacrylate, poly styrene-co-2-amino-2-methylpropyl methacrylate, and poly styrene-co-3-amino-3-methyl-1-butyl methacrylate, poly styrene-co-2-amino-2-methylhexyl methacrylate, and the like. Specific examples of epoxy containing polymers are poly methyl methacrylate-co-glycidyl methacrylate and poly styrene-co-glycidyl methacrylate. Weight average molecular weight ($M_w$) values for the amine and epoxy containing polymers can be in the range of, for example, about 15,000 to about 500,000 and $M_n$ (number average) values for the amine and epoxy containing polymers can be, for example, in the range of about 7,000 to about 220,000; and mole percent of amine and epoxy groups in the amine and epoxy polymers respectively can be in the range of about 0.1 to about 20 mole percent.

The monomers for synthesizing the above polymers can be obtained from a number of sources, such as Aldrich Chemical Company with respect to methylmethacrylate, and for example, Scientific Polymer Products with regard to and t-butylaminoethyl methacrylate. Synthetic methods for the preparation of polymers and copolymers from these monomers may be by bulk polymerization, solution polymerization, emulsion polymerization, suspension or semisuspension polymerization or other known suitable polymerization methods.

The polymers selected to generate the carrier coatings can thus be prepared by bulk polymerization which can be accomplished with monomers in the absence of solvent, and by solution polymerization can be effected in a solvent medium, such as toluene, in which the monomer or mixture of monomers is combined with a suitable initiator, such as 2,2'-azobis(2-methylpropionitrile), referred to as AIBN, and reacted for an effective period of time, for example from about 7 to about 15, and preferably about 11 hours, at an elevated temperature, for example about 70° C. to about 90° C. From this reaction, a solution with a solids content of, for example, about 22.7 percent by weight polymer can be obtained, and wherein the polymer has a glass transition of about 108° C., and molecular weight by gel permeation chromatography of $M_w$=about 90,000 with molecular weight dispersibility, that is the ratio of $M_w/M_n$, or MWD=of about 2.3.

Suspension polymerization methods involve mixing monomers and initiator, such as AIBN, to obtain a clear organic phase. The organic phase is then combined with an aqueous solution of Air Products Airvol 603 Polyvinyl Alcohol, and a potassium iodide aqueous phase inhibitor. The desired particle size can be obtained by homogenizing the two phases with a Brinkman homogenizer equipped with a Polytron Generator with three stationary and three moving rings of flat rotor design for about five minutes at about 8,000 RPM. The resulting suspended organic phase is then transferred to the preheated reactor and stirred at about 65 RPM to maintain stability of the suspension, maintained at 70° C. for 6 hours and 40 minutes to complete polymerization, cooled, removed from the reactor, washed and centrifuged 5 times with a 90/10 volume ratio of methanol/water, and finally washed with water only. The wet polymer suspension is then air dried, placed in a vacuum oven at from about 40.0° C. to 80.0° C. to complete drying, and further broken down to its primary particle size by ball milling followed by screen sieving. This process yields a polymer particle size having a volume median of, for example, about 4.0 $\mu$, a second pass glass transition onset temperature of 95.8° C., and a molecular weight $M_w$ by gel permeation chromatography of about 520,000 with an about MWD of about 2.2.

Emulsion polymerization can be accomplished by the continuous addition to a suitable reaction vessel containing water, and providing mechanical stirring, a nitrogen atmosphere, and thermostatic control, a mixture of monomers and an initiator, such as ammonium persulfate initiator, as obtained from Aldrich Chemical Company (0.2 to 0.6 percent by weight of monomers). The polymerization can be effected by heating to, for example, between about 55 and about 65° C. to achieve polymer molecular weights, $M_w$ by gel permeation chromatography ranging from, for example, about 200,000 to about 900,000. The polymer or copolymer powder is isolated by freeze drying in vacuo, the residue free latex, and the resulting polymer particle diameter size is, for example, about 0.1 to about 2.0 microns in volume average diameter.

The carrier polymer coating preferably has dispersed therein in embodiments conductive components, such as metal oxides like tin oxide, conductive carbon blacks, and the like, in effective amounts of, for example, from about 0 to about 70 and preferably from about 15 to about 60 weight percent. Specific examples of conductive components include the conductive carbon black SC Ultra available from Conductex, Inc., and antimony-doped tin oxide Zelec ECP3005-XC manufactured by E. I. DuPont.

The process for incorporating the polymer onto a carrier core can be sequential, a process in which one of the two polymers, when two polymers are selected, is initially fused to the surface, and the second polymer is fused to the surface in a subsequent fusing operation. Alternatively, the process for incorporation can comprise a single fusing.

Various effective suitable processes can be selected to apply the polymer, or mixture, for example from 2 to about 5, and preferably two, of polymer coatings to the surface of the carrier particles. Examples of typical processes for this purpose include combining the carrier core material, and the polymers and conductive component by cascade roll mixing, or tumbling, milling, shaking, electrostatic powder cloud spraying, fluidized bed, electrostatic disc processing, and an electrostatic curtain. Following application of the polymers, heating is initiated to permit flow out of the coating material over the surface of the carrier core. The concentration of the coating material powder particles, and the parameters of the heating step may be selected to enable the formation of a continuous film of the coating polymers on the surface of the carrier core, or permit only selected areas of the carrier core to be coated. When selected areas of the metal carreir core remain uncoated or exposed, the carrier particles will possess electrically conductive properties when the core material comprises a metal. The aforementioned conductivities can include various suitable values. Generally, however, this conductivity is from about $10^{-7}$ to about $10^{-17}$ mho-cm$^{-1}$ as measured, for example, across a 0.1 inch magnetic brush at an applied potential of 10 volts; and wherein the coating coverage encompasses from about 10 percent to about 100 percent of the carrier core. Moreover, as indicated herein known solution processes may be selected for the preparation of the coated carriers.

The carrier polymer coating can have incorporated therein various known charge enhancing additives, such as quaternary ammonium salts, and more specifically, distearyl dimethyl ammonium methyl sulfate (DDAMS), bis[1-[(3,5-disubstituted-2-hydroxyphenyl)azo]-3-(mono-substituted)-2-naphthalenolato(2-)]chromate(1-), ammonium sodium and hydrogen (TRH), cetyl pyridinium chloride (CPC), FANAL PINK® D4830, and the like, including those as illustrated in a number of the patents recited herein, and other effective known charge agents or additives. The charge additives can be selected in various effective amounts, such as from about 0.05 to about 15, and from about 0.1 to about 3 weight percent, based, for example, on the sum of the weights of polymer, conductive additive, and charge additive components. The addition of various known charge enhancing additives can act to further increase the triboelectric charge imparted to the carrier, and therefore, further increase the negative triboelectric charge imparted to the toner in, for example, a xerographic development subsystem.

Examples of second polymers selected can include polymonoalkyl methacrylates or acrylates, polyurethanes, fluorocarbon polymers such as polyvinylidenefluoride, polyvinylfluoride, and polypentafluorostyrene, polyethylene, polyethylene-co-vinylacetate, polyvinylidenefluoride-co-tetrafluoroethylene, and the like, inclusive of other known suitable polymers. Other known related polymers not specifically mentioned herein may also be selected, such as those illustrated in the U.S. Pat. No. 4,937,166 and 4,935,326 patents mentioned herein.

A specific second polymer is comprised of a thermosetting polymer and yet, more specifically, a poly(urethane) thermosetting resin which contains, for example, from about 75 to about 95, and preferably about 80 percent by weight of a polyester polymer, which when combined with an appropriate crosslinking agent, such as isopherone diisocyannate and initiator such as dibutyl tin dilaurate forms a crosslinked poly(urethane) resin at elevated temperatures. An example of a polyurethane is poly(urethane)/polyester polymer or Envirocron (product number PCU10101, obtained from PPG Industries, Inc.). This polymer has a melt temperature of between about 210° F. and about 266° F., and a crosslinking temperature of about 345° F. This second polymer is mixed together with the first copolymer polymer, generally prior to mixing with the core, which when fused forms a uniform coating of the first and second polymers on the carrier surface. The second polymer is present in an amount of from about 0 percent to about 99 percent by weight, based on the total weight of the first and second polymers and the conductive component in the first polymer.

The advantages of the carriers of the present invention include in embodiments high robust carrier tribo charge of a positive value, high toner tribo charge of a negative value, excellent admix, for example from about 1 to about 30 seconds as determined in the charge spectrograph, increased resistance of the carrier to mechanical aging in a xerographic environment and a decreased sensitivity of the carrier triboelectric value to the relative humidity of the environment, and the like. More specifically, the toner tribo can be, for example, from about a minus 50 to about a minus 150, from about a minus 55 to about a minus 90, or from about a minus 60 to about a minus 85, with corresponding positive tribo charges for the carrier. The tribo can be determined by a number of known methods, such as the use of a Faraday Cage. With respect to high toner tribo charge of a negative value, this property is important to xerographic, especially color xerography and printing, primarily because there is enabled development of toner particles into regions of the imaging member, such as a photoreceptor where strong fringe electrical fields exist, that is, at the borders of solids areas and lines. Developing toner particles through these fringe fields minimizes or eliminates the untoned part of the image which appears between two adjacent colors in an image.

Illustrative examples of toner binders, include thermoplastic resins, which when admixed with the carrier generates developer compositions, such binders including styrene based resins, styrene acrylates, styrene methacrylates, styrene butadienes, polyamides, vinyl resins, polyesters, such as those obtained by the polymeric esterification products of a dicarboxylic acid and a diol comprising a diphenol. Specific vinyl monomers that can be selected are styrene, p-chlorostyrene vinyl naphthalene, unsaturated monoolefins, such as ethylene, propylene, butylene and isobutylene; vinyl fluoride, vinyl acetate, vinyl propionate, vinyl benzoate, and vinyl butyrate; vinyl esters like the esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; N-vinyl indole, N-vinyl pyrrolidene; styrene butadiene copolymers; mixtures thereof; and other similar known resins.

As one toner resin, there can be selected the esterification products of a dicarboxylic acid and a diol comprising a diphenol, reference U.S. Pat. No. 3,590,000, the disclosure of which is totally incorporated herein by reference. Other specific toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol. Also, the crosslinked and reactive extruded polyesters of U.S. Pat. No. 5,376,494, the disclosure of which is totally incorporated herein by reference, may be selected as the toner resin.

Generally, from about 1 part to about 5 parts by weight of toner particles are mixed with from about 10 to about 300 parts by weight of the carrier particles.

Numerous well known suitable colorants, such as pigments dyes, or mixtures thereof, and preferably pigments can be selected as the colorant for the toner particles including, for example, carbon black, nigrosine dye, lamp black, iron oxides, magnetites, and mixtures thereof, known cyan, magenta, yellow pigments, and dyes. The colorant, which is preferably carbon black, should be present in a sufficient amount to render the toner composition highly colored. Thus, the colorant can be present in amounts of, for example, from about 1 percent by weight to about 20, and preferably from about 5 to about 12 percent by weight, based on the total weight of the toner components, however, lesser or greater amounts of colorant may be selected. Illustrative examples of magentas that may be selected include 1,9-dimethyl-substituted quinacridone and anthraquinone dye identified in the Color Index as CI 60720, CI Dispersed Red 15, a diazo dye identified in the Color Index as CI 26050, CI Solvent Red 19, Pigment Blue 15:3, and the like. Examples of cyans that may be used include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. Other known suitable colorants, such as reds, blues, browns, greens, oranges, and the like, inclusive of dyes thereof can be selected. These colorants are generally present in the toner composition in an amount of from about 1 weight percent to about 15, and, for example, from about 2 to about 12 weight percent based on the weight of the toner components of binder and colorant. Examples of dyes include known dyes, such as food dyes and the like.

When the colorant particles are comprised of magnetites, which are a mixture of iron oxides ($FeO.Fe_2O_3$), including those commercially available as MAPICO BLACK®, they are present in the toner composition in an amount of from about 10 percent by weight to about 70 percent by weight, and preferably in an amount of from about 20 percent by weight to about 50 percent by weight.

Colorant includes pigment, dye, mixtures thereof, mixtures of pigments, mixtures of dyes, and the like.

The resin particles are present in a sufficient, but effective amount, thus when 10 percent by weight of pigment, or colorant, such as carbon black like REGAL 330®, is contained therein, about 90 percent by weight of binder material is selected. Generally, the toner composition is comprised of from about 85 percent to about 97 percent by weight of toner resin particles, and from about 3 percent by weight to about 15 percent by weight of colorant particles such as carbon black.

For further enhancing the charging characteristics of the developer compositions described herein, and as optional components, there can be incorporated therein with respect to the toner charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; U.S. Pat. No. 4,560,635, the disclosure of which is totally incorporated herein by reference; and other similar known charge enhancing additives, such as metal complexes, BONTRON E-84™, BONTRON E-88™, and the like. These additives are usually selected in an amount of from about 0.1 percent by weight to about 20, and, for example, from about 3 to about 12 percent by weight. These charge additives can also be dispersed in the carrier polymer coating as indicated herein.

The toner composition of the present invention can be prepared by a number of known methods including melt blending the toner resin particles, and colorants of the present invention followed by mechanical attrition, in situ emulsion/aggregation/coalescence, reference U.S. Pat. Nos. 5,370,963; 5,344,738; 5,403,693; 5,418,108; 5,364,729 and 5,405,728, the disclosures of which are totally incorporated herein by reference, and the like. Other methods include those well known in the art such as spray drying, melt dispersion, dispersion polymerization and suspension polymerization. In one dispersion polymerization method, a solvent dispersion of the resin particles and the colorant are spray dried under controlled conditions to result in the desired product. Toner particles sizes and shapes are known and include, for example, a toner size of from about 2 to about 25, and preferably from about 6 to about 14 microns in volume average diameter as determined by a Coulter Counter; shapes of irregular, round, spherical, and the like may be selected.

The toner and developer compositions may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. Nos. 4,265,990, 4,585,884, 4,584,253, and 4,563,408, the disclosure of each patent being totally incorporated herein by reference, and other similar layered photoresponsive devices. Examples of generating layers are trigonal selenium, metal phthalocyanines, metal free phthalocyanines, titanyl phthalocyanines, hydroxygallium phthalocyanines, and vanadyl phthalocyanines. As charge transport molecules there can be selected the aryl diamines disclosed in the aforementioned patents, such as the '990 patent. These layered members are conventionally charged negatively thus requiring a positively charged toner.

Images, especially colored images obtained with the developer compositions of the present invention in embodiments possess, for example, acceptable solids, excellent halftones, and desirable line resolution with acceptable or substantially no background deposits, excellent chroma, superior color intensity, constant color chroma and intensity over extended time periods, such as 1,000,000 imaging cycles, and the like.

The following Examples are being provided to further define the present invention, it being noted that these Examples are intended to illustrate and not limit the scope of the present invention. Parts and percentages are by weight unless otherwise indicated.

SYNTHETIC EXAMPLE I

Synthesis of Poly(methyl methacrylate-co-glycidylmethacrylate) with Carbon Black (PMMA/GMA/CB) as follows:

To a 1-liter stainless steel Parr reactor was added 76.7 grams methyl methacrylate (MMA), 11.5 grams glycidyl methacrylate (GMA), 480 toluene, 6.3 grams azobis (cyanohexane) (Vazo-88), 6.3 grams benzoyl peroxide (Lucidol 75), and 132.9 grams Conductex SC Ultra carbon black. The reactor was stirred with a pitch blade impeller at 230 rpm. The temperature was raised to 95° C. and held for 6 hours, followed by a temperature ramp of 0.14 °C./minute to 110° C. The reactor was then cooled to room temperature. The reactor contents were poured into a foil tray and toluene was evaporated by air drying. The resulting dry material was ground with a coffee mill, and further dried in a vacuum dryer at 80° C. for 6 hours. The resulting PMMA/GMA/CB copolymer, hereafter referred to as SOLP, was in the form of a coarse, sandy powder. It contained 39.6 weight percent carbon black, 59.0 weight percent polymer, and 1.4 weight percent volatiles as measured by thermogravimetric analysis (TGA).

To a 500 milliliter glass reactor was added 86 grams MMA, 10 grams GMA, and 59 grams SOLP (from above). This was stirred with a pitch blade impeller at 200 rpm for 15 hours. To this mixture was added 4.1 grams 2,2'-azobis (2,4-dimethylvaleronitrile) (Vazo-52), 2.1 grams 2,2'-azobis-2-methyl-butanenitrile (Vazo-67), and 2.9 grams benzoyl peroxide (Lucidol 75). Stirring was continued at 200 rpm for 2 hours. 150 Grams of this mixture was added to a mixture of 439.6 grams deionized water, 15.4 polyvinyl alcohol (Airvol 603), and 5 grams potassium iodide. The mixture was stirred for 2 minutes at 200 rpm with a pitch blade impeller, followed by homogenizing at 800 rpm for 5 minutes with a Brinkmann Polytron. The resulting mixture was charged to a 1 liter Parr reactor and stirred at 230 rpm with a pitch blade impeller. The temperature was raised to 60° C. and held for 1.5 hours, and then raised to 80° C. and held for 1.5 hours. The reactor was then cooled to room temperature, about 25° C. throughout. The final slurry was added to a mixture of 406 grams methanol and 46 grams deionized water, centrifuged at 3,000 rpm for 3 minutes, and decanted. The resulting wet cake was washed three more times in this manner, followed by a final wash with 900 grams deionized water. The final wet cake was vacuum dried at 80° C. and then ground with a coffee mill. The final product was a PMMA/GMA/CB copolymer in the form of a fine talc-like black powder. The composition of this copolymer by TGA was 26.3 weight percent carbon black, 72.9 weight percent polymer, and 0.8 weight percent volatiles.

SYNTHETIC EXAMPLE II

Synthesis of poly(methyl methacrylate-co-t-butylaminoethyl methacrylate) (PMMA/tBAEMA) as follows:

To a 1-liter Parr reactor was added 105 grams MMA, 45 grams t-butylaminoethyl methacrylate (tBAEMA), 1.2 grams 2,2'-azobis(2,4-dimethylvaleronitrile) (Vazo-52), and 0.6 grams 2,2'-azobis-2-methyl-butanenitrile (Vazo-67). This was stirred at 200 rpm for 10 minutes to dissolve the initiators. This mixture was added to a mixture of 439.6 grams deionized water, 15.4 polyvinyl alcohol (Airvol 603), and 5 grams potassium iodide. The mixture was stirred for 2 minutes at 200 rpm with a pitch blade impeller, followed by homogenizing at 800 rpm for 5 minutes with a Brinkmann Polytron. The resulting mixture was charged to a 1 liter Parr reactor and stirred at 230 rpm with a pitch blade impeller. The temperature was raised to 60° C. and held for 1.5 hours, and then raised to 80° C. and held for 1.5 hours. The reactor was then cooled to room temperature. The final slurry was added to a mixture of 406 grams methanol and 46 grams deionized water, centrifuged at 3,000 rpm for 3 minutes, and decanted. The wet cake was washed two more times in this manner, followed by a final wash with 900 grams deionized water. The final wet cake was vacuum dried at 80° C. and then ground with a coffee mill. The final product was a PMMA/tBAEMA copolymer in the form of a fine talc-like white powder.

CARRIER EXAMPLE I

A carrier coated with poly(methyl methacrylate-co-glycidylmethacrylate) with carbon black (PMMA/NGMA/CB) was prepared as follows:

In the first step of the carrier coating process, 2.85 grams of PMMA/GMA/CB copolymer prepared in Synthetic Example I and 190 grams of 77 micron volume median diameter irregular steel core (obtained from Hoeganaes), with the core size determined in this and all following carrier examples by a standard laser diffraction technique were mixed in a 250 milliliters plastic bottle. The mixing was accomplished with a hand shaker for a period of 45 minutes. There resulted uniformly distributed and electrostatically attached polymer on the core as determined by visual observation. In the second step, the mixture was added to a single-drive batch melt mixing device (obtained from Haake) under the conditions of 5 rpm for a period of 30 minutes at a temperature of 205° C., thereby causing the polymer to melt and fuse to the core. This resulted in a continuous uniform polymer coating on the core. The final product was comprised of a carrier core with a total of 1.5 percent polymer by weight on the surface, with the weight percent of poly(methyl methacrylate-co-glycidylmethacrylate) with carbon black (88 percent/2 percent monomer ratio in the polymer and containing 26.3 weight percent carbon black and 72.9 weight percent polymer overall) determined in this and all following carrier examples by dividing the difference between the weights of the fused carrier and the carrier core by the weight of the fused carrier.

A developer composition was then prepared by mixing 200 grams of the above prepared carrier with 8 grams of a 7 micron volume median diameter (volume average diameter) toner composition comprised of a pigment of carbon black, like REGAL 330® and a partially crosslinked polyester resin with 7 percent (by weight) gel content, obtained by the reactive extrusion of a linear bisphenol A propylene oxide fumarate polymer. This developer was conditioned for 18 hours at 50 percent RH. The resulting developer was shaken on a paint shaker, and 0.3 grams samples were removed after 1 minute, 15 minutes, and 90 minutes. Thereafter at each of these mixing times, the triboelectric charge on the carrier particles was determined by the known Faraday Cage process. The results are summarized in Table 1. Further, the conductivity of the carrier as determined by forming a 0.1 inch long magnetic brush of the carrier particles, and measuring the conductivity by imposing a 10 volt potential across the brush was $3.2\times10^{-12}$ $(\text{mho-cm})^{-1}$. Therefore, these carrier particles were insulative.

CARRIER EXAMPLE II

A carrier coated with of poly(methyl methacrylate-co-t-butylaminoethyl methacrylate) (PMMA/tBAEMA) was prepared as follows:

In the first step of the carrier coating process, 2.85 grams of PMMA/tBAEMA copolymer prepared in Synthetic Example II and 190 grams of 77 micron volume median diameter irregular steel core (obtained from Hoeganaes)

were mixed in a 250 milliliters plastic bottle. The mixing was accomplished with a hand shaker for a period of 45 minutes. There resulted uniformly distributed and electrostatically attached polymer on the core as determined by visual observation. The second step of the coating process is identical to that of Carrier Example I. The final product was comprised of a carrier core with a total of 1.5 percent coating weight poly(methyl methacrylate-co-t-butylaminoethyl methacrylate) (70 percent/30 percent monomer ratio) by weight on the surface.

A developer composition was then prepared by mixing 200 grams of the above prepared carrier with 8 grams of a 7 micron volume median diameter (volume average diameter) toner composition identical to that of Carrier Example I. This developer was conditioned for 18 hours at 50 percent RH. The resulting developer was shaken on a paint shaker, and 0.3 grams samples were removed after 1 minute, 15 minutes, and 90 minutes. Thereafter, at each of these mixing times, the triboelectric charge on the carrier particles was determined by the known Faraday Cage process. The results are summarized in Table 1. Further, the conductivity of the carrier as determined by forming a 0.1 inch long magnetic brush of the carrier particles, and measuring the conductivity by imposing a 10 volt potential across the brush was $1.0\times10^{-8}$ (mho-cm)$^{31\ 1}$. Therefore, these carrier particles were conductive.

polymer consisting of 1.1 percent coating weight of poly (methyl methacrylate-co-glycidylmethacrylate) with carbon black (88 percent/12 percent monomer ratio in the polymer and containing 26.3 weight percent carbon black and 72.9 weight percent polymer overall) and 0.4 percent coating weight of poly(methyl methacrylate-co-t-butylaminoethyl methacrylate) (70 percent/30 percent monomer ratio). It is believed that the tBAEMA and GMA functionalities react on the surface of the core, forming a very high molecular weight crosslinked polymer composite as a result.

A developer composition was then prepared by mixing 200 grams of the above prepared carrier with 8 grams of a 7 micron volume median diameter (volume average diameter) toner composition identical to that of Carrier Example I. This developer was conditioned for 18 hours at 50 percent RH. The resulting developer was shaken on a paint shaker, and 0.3 gram samples were removed after 1 minute, 15 minutes, and 90 minutes. Thereafter, at each of these mixing times, the triboelectric charge on the carrier particles was determined by the known Faraday Cage process. The results are summarized in Table 1. Further, the conductivity of the carrier as determined by forming a 0.1 inch long magnetic brush of the carrier particles, and measuring the conductivity by imposing a 10 volt potential across the brush was $3.0\times10^{-9}$ (mho-cm)$^{-1}$. Therefore, these carrier particles were conductive.

TABLE 1

| | | Paint Shaker Charging 50 percent RH | | | | | | | |
|---|---|---|---|---|---|---|---|---|---|
| | | 1 Minute | | 15 Minutes | | 90 Minutes | | q/m Ratio | |
| Ex. | Coating Resin | q/m (μC/g) | TC (percent) | q/m (μC/g) | TC (percent) | q/m (μC/g) | TC (percent) | 15'/1' | 90'/1' |
| I | PMMA/GMA/CB | −24.0 | 3.4 | −23.0 | 3.4 | −12.4 | 2.8 | 0.96 | 0.52 |
| II | PMMA/tBAEMA | −45.4 | 3.5 | −38.7 | 3.2 | −15.7 | 3.4 | 0.85 | 0.35 |
| III | 30 percent PMMAtBAEMA + 70 percent PMMA/GMA/CB (6.3 m percent tBAEMA/4.9 m percent GMA, 18.4 wt percent CB) | −65.8 | 3.8 | −55.4 | 4.0 | −46.2 | 3.8 | 0.84 | 0.70 |

CARRIER EXAMPLE III

A carrier coated with of poly(methyl methacrylate-co-t-butylaminoethyl methacrylate) (PMMA/tBAEMA) and poly (methyl methacrylate-co-glycidylmethacrylate) with carbon black (PMMA/GMA/CB) was prepared as follows:

In the first step of the carrier coating process, 0.85 grams of PMMA/tBAEMA copolymer prepared in Synthetic Example II, 2.00 grams of PMMA/GMA/CB copolymer prepared in Synthetic Example I and 190 grams of 77 micron volume median diameter irregular steel core (obtained from Hoeganaes) were mixed in a 250 milliliters plastic bottle. The mixing was accomplished with a hand shaker for a period of 45 minutes. There resulted uniformly distributed and electrostatically attached polymer on the core as determined by visual observation. The second step of the coating process is identical to that of Carrier Example I. The final product was comprised of a carrier core with a total of 1.5 percent coating weight of polymer on the surface, the Other embodiments and modifications of the present invention may occur to those of ordinary skill in the art subsequent to a review of the present application and the information presented herein; these embodiments modifications, and equivalents, or substantial equivalents thereof, are also included within the scope of the present invention.

What is claimed is:

1. A carrier comprised of a core and thereover a polymer generated from the reaction of a component containing amine groups and a component containing epoxy groups, and wherein the amine groups are generated from an aminoalkyl methacrylate, or monoalkyl aminoalkyl methacrylate, and the epoxy groups are generated from glycidyl methacrylate.

2. A carrier in accordance with claim 1 wherein each of said alkyl independently contains from 1 to about 25 carbon atoms.

3. A carrier in accordance with claim 1 wherein each of said alkyl independently contains from 1 to about 6 carbon atoms.

4. A carrier in accordance with claim 1 wherein the polymer is a copolymer of an aminoalkyl methacrylate, or monoalkyl aminoalkyl methacrylate and glycidyl methacrylate.

5. A carrier in accordance with claim 1 wherein said epoxy groups are generated from glycidyl methacrylate, diglycidyl 1,2,3,6-tetrahydrophthalate, 1,2-epoxy-9-decene, 1,2-epoxy-5-hexene, 1,2-epoxy-7-octene, 3,4-epoxy-1-butene, poly(phenyl glycidyl ether), bisphenol A glycerolate (1 glycerol/phenol) diacrylate, or glycidyl vinylbenzyl ether.

6. A carrier in accordance with claim 1 wherein the copolymer contains from about 5 to about 20 mole percent of amine groups and from about 5 to about 20 mole percent of epoxy groups with the remainder of the polymer optionally being comprised of non-amino and non-epoxy monomers of styrene, vinyl toluene, methyl methacrylate, butyl styrene, neopentyl methacrylate, isobutyl methacrylate or isobutyl acrylate.

7. A carrier in accordance with claim 1 wherein the polymer possesses an $M_w$ of from about 20,000 to about 2,000,000, and an $M_n$ of from about 12,000 to about 2,000,000.

8. A carrier in accordance with claim 1 wherein the polymer is a copolymer and the coating weight thereof is from about 0.1 to about 20 weight percent.

9. A carrier in accordance with claim 1 wherein the polymer coating weight is from about 1 to about 3 weight percent.

10. A carrier in accordance with claim 1 wherein the polymer contains a conductive component.

11. A carrier in accordance with claim 10 wherein the conductive component is a metal oxide, or is carbon black.

12. A carrier in accordance with claim 11 wherein said conductive component is carbon black selected in an amount of from about 10 to about 60 weight percent.

13. A carrier in accordance with claim 1 wherein said core is a metal, a metal oxide, or a ferrite.

14. A carrier in accordance with claim 1 with a triboelectric charge of from about a positive 50 to about a positive 150 microcoulombs per gram.

15. A carrier in accordance with claim 1 with a triboelectric charge of from about a positive 50 to about a positive 70 microcoulombs per gram.

16. A developer comprised of the carrier of claim 1 and toner.

17. A developer in accordance with claim 16 wherein the toner is comprised of resin and colorant.

18. A developer in accordance with claim 17 wherein the colorant is a pigment and the resin is a styrene copolymer, or a polyester.

19. A developer comprised of a (1) carrier core and coating layer of a polymer, or polymers generated from a component containing at least one epoxy group and amine group, and (2) a toner, and wherein the amine group is generated from an aminoalkyl methacrylate, or monoalkyl aminoalkyl methacrylate, and the epoxy group is generated from glycidyl methacrylate.

20. A developer in accordance with claim 19 wherein the carrier core is selected from the group consisting of iron, ferrites, steel and nickel.

21. A developer in accordance with claim 19 with a carrier triboelectric charge of from about a positive 50 to about a positive 150 microcoulombs per gram, and a toner triboelectric charge of from about a negative 50 to about a negative 150 microcoulombs per gram.

22. A developer in accordance with claim 19 with a carrier triboelectric charge of from about a positive 60 to about a positive 70 microcoulombs per gram, and a toner triboelectric charge of from about a negative 60 to about a negative 70 microcoulombs per gram.

23. A carrier in accordance with claim 1 wherein said amine component is a copolymer of poly methyl methacrylate-co-2-amino-2-methylpropyl methacrylate, poly methyl methacrylate-co-3-amino-3-methyl-1-butyl methacrylate, poly methyl methacrylate-co-2-amino-2-methylhexyl methacrylate, poly methyl methacrylate-co-t-butylaminoethyl methacrylate, poly styrene-co-2-amino-2-methylpropyl methacrylate; poly styrene-co-t-butylaminoethyl methacrylate, poly styrene-co-3-amino-3-methyl-1-butyl methacrylate, and poly styrene-co-2-amino-2-methylhexyl methacrylate; and said epoxy component is poly methyl methacrylate-co-glycidyl methacrylate and poly styrene-co-glycidyl methacrylate.

24. A carrier in accordance with claim 1 wherein the carrier contains a further polymer coating.

25. A carrier in accordance with claim 24 wherein the further coating is comprised of a styrene acrylate, a styrene methacrylate, or a fluoropolymer.

26. A carrier in accordance with claim 24 wherein said further coating is comprised of a polyurethane, and which polyurethane optionally contains dispersed therein conductive components.

27. A carrier in accordance with claim 24 wherein the further coating is comprised of a polyurethane/polyester with carbon black optionally dispersed therein.

28. A carrier in accordance with claim 1 wherein said alkyl aminoethyl methacrylate is a tertiarybutylaminoethyl methacrylate.

29. An imaging process which comprises developing an image with the toner of claim 1.

30. A process for the preparation of the carrier of claim 1 by the dry mixing and heating of said core and said coating.

31. A carrier in accordance with claim 1 wherein said polymer resulting possesses weight average molecular weights of from about 15,000 to about 500,000 and number average molecular weight values $M_n$ of from about 7,000 to about 220,000.

32. A carrier in accordance with claim 1 wherein said amine containing component is a monomer and said epoxy containing component is a monomer.

33. A carrier in accordance with claim 1 wherein said polymer is crosslinked.

34. A carrier in accordance with claim 1 wherein said polymer is generated from monomers.

35. A carrier in accordance with claim 1 wherein said polymer is generated from polymers.

36. A carrier comprised of a core and thereover a polymer generated from the reaction of a polymer component containing amine groups and a polymer component containing epoxy groups, and wherein the amine groups are generated from an aminoalkyl methacrylate, or monoalkyl aminoalkyl methacrylate, and the epoxy groups are generated from glycidyl methacrylate.

37. A carrier consisting essentially of a core and thereover a polymer generated from the reaction of a component containing amine groups and a component containing epoxy groups, and wherein the amine groups are generated from an aminoalkyl methacrylate, or monoalkyl aminoalkyl methacrylate, and the epoxy groups are generated from glycidyl methacrylate.

* * * * *